US011316270B2

(12) United States Patent
Brobston

(10) Patent No.: US 11,316,270 B2
(45) Date of Patent: Apr. 26, 2022

(54) SYSTEMS FOR THERMO-ELECTRIC ACTUATION OF BASE STATION ANTENNAS TO SUPPORT REMOTE ELECTRICAL TILT (RET) AND METHODS OF OPERATING SAME

(71) Applicant: CommScope Technologies LLC, Hickory, NC (US)

(72) Inventor: Michael Brobston, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/754,577

(22) PCT Filed: Oct. 1, 2018

(86) PCT No.: PCT/US2018/053701
§ 371 (c)(1),
(2) Date: Apr. 8, 2020

(87) PCT Pub. No.: WO2019/074704
PCT Pub. Date: Apr. 18, 2019

(65) Prior Publication Data

US 2020/0350675 A1 Nov. 5, 2020

Related U.S. Application Data

(60) Provisional application No. 62/571,390, filed on Oct. 12, 2017.

(51) Int. Cl.
*H01Q 3/32* (2006.01)
*H01Q 1/24* (2006.01)
*H01Q 21/08* (2006.01)

(52) U.S. Cl.
CPC ..... *H01Q 3/32* (2013.01); *H01Q 1/246* (2013.01); *H01Q 21/08* (2013.01)

(58) Field of Classification Search
CPC ..... H01Q 3/30; H01Q 3/32; H01Q 1/246; H01Q 21/08; H01P 1/18
See application file for complete search history.

(56) References Cited

U.S. PATENT DOCUMENTS 10,337,505 B2 * 7/2019 Lamb ..... G05D 23/02
10,461,421 B1 * 10/2019 Tran ..... F21S 8/086
(Continued)

FOREIGN PATENT DOCUMENTS

EP 3125366 A1 2/2017
WO 2016/137567 A1 9/2016
WO 2016/173614 A1 11/2016

OTHER PUBLICATIONS

International Search Report and Written Opinion of the International Searching Authority corresponding to International Application No. PCT/US2018/053701 (12 pages) (dated Jan. 8, 2019).
(Continued)

*Primary Examiner* — Andrea Lindgren Baltzell
*Assistant Examiner* — Yonchan J Kim
(74) *Attorney, Agent, or Firm* — Myers Bigel, P.A.

(57) ABSTRACT

Base station antennas (BSAs) include at least one feed signal phase shifter having a variable length signal path therein, which provides an adjustable signal delay in response to mechanical actuation thereof. A thermo-electric actuator is provided to support remote electrical tilt operations by mechanically actuating the variable length signal path in response to an actuator drive signal. The thermo-electric actuator may include thermally-deformable components, such as SMA springs and wax motors.

9 Claims, 16 Drawing Sheets

(56) References Cited

U.S. PATENT DOCUMENTS

| | | | | |
|---|---|---|---|---|
| 2002/0126059 | A1 | 9/2002 | Zimmerman et al. | |
| 2003/0048230 | A1 | 3/2003 | Heinz et al. | |
| 2004/0183615 | A1* | 9/2004 | Dybdal | H01P 1/122 333/21 A |
| 2006/0221430 | A1* | 10/2006 | Zhu | H01H 61/02 359/290 |
| 2007/0080886 | A1 | 4/2007 | Thomas et al. | |
| 2008/0186108 | A1* | 8/2008 | Miya | H03H 11/16 333/139 |
| 2008/0297414 | A1 | 12/2008 | Krishnaswamy et al. | |
| 2010/0201590 | A1 | 8/2010 | Girard et al. | |
| 2016/0372809 | A1* | 12/2016 | Liu | H01P 5/182 |
| 2017/0186578 | A1* | 6/2017 | Koul | H01P 3/003 |
| 2017/0230028 | A1* | 8/2017 | Gamal El Din | H03H 7/20 |
| 2019/0288391 | A1* | 9/2019 | Jaime | H01Q 1/246 |
| 2019/0331220 | A1* | 10/2019 | Fu | H01P 1/18 |

OTHER PUBLICATIONS

Sakib et al. "An approach to build simplified semi-autonomous Mars Rover" 2016 IEEE Region 10 Conference (TENCON) (pp. 3502-3505) (Nov. 22-25, 2016).

* cited by examiner

SYSTEMS FOR THERMO-ELECTRIC ACTUATION OF BASE STATION ANTENNAS TO SUPPORT REMOTE ELECTRICAL TILT (RET) AND METHODS OF OPERATING SAME

REFERENCE TO PRIORITY APPLICATIONS

This application is a 35 U.S.C. § 371 national stage application of PCT International Application No. PCT/US2018/053701, filed Oct. 1, 2018, which claims priority to U.S. Provisional Application Ser. No. 62/571,390, filed Oct. 12, 2017, the disclosures of each are hereby incorporated herein by reference. The above-referenced PCT International Application was published in the English language as International Publication No. WO 2019/074704 A1 on Apr. 18, 2019.

FIELD OF THE INVENTION

The present invention relates to radio communications and antenna devices and, more particularly, to base station antenna arrays for cellular communications and methods of operating same.

BACKGROUND

A common feature for cellular base station antennas is remote electrical tilt (RET), which allows the elevation pattern of an antenna to be controlled remotely in its down tilt relative to the horizon or boresight angle. This feature allows wireless service providers the capability of adjusting the cellular coverage on the ground to thereby optimize the performance of a wireless network in adapting to variations in a service demand profile or to manage interference into adjacent cells. The remote electrical tilt function is typically implemented using a phased array technique in which an RF signal is divided and then combined between an array of individual radiating elements. The RF signal received by or transmitted from each radiating element is adjusted in phase to implement the elevation pattern tilt. By providing the same RF signal phase to each radiating element, the elevation pattern is effectively pointed toward the mechanical boresight of the antenna. But, by creating a linear phase offset between adjacent radiating elements in the array, the peak of the elevation pattern can be steered off from the boresight angle to an offset angle.

As will be understood by those skilled in the art, the phase offsets are typically developed using electrical phase shifters (a/k/a time delay units) that can be varied in their phase shift or time delay response within the base station antennas. For example, as shown by FIG. 1A, in a conventional phased array antenna 10, a radio frequency (RF) feed current may be provided from a transmitter (TX) to a plurality of spaced-apart antenna radiating elements via phase shifters ($\Phi_1$-$\Phi_8$), which establish a desired phase relationship between the radio waves emitted by the spaced-apart radiating elements. In particular, a properly established phase relationship enables the radio waves emitted from the radiating elements to combine to thereby increase radiation in a desired direction (shown as θ), yet suppress radiation in an undesired direction(s). The phase shifters ($\Phi_n$) are typically controlled by a computer control system (CONTROL), which can alter the phases of the emitted radio waves and thereby electronically steer the combined waves in varying directions.

For example, in a typical cellular communications system, a geographic area is often divided into a series of regions that are commonly referred to as "cells", which are served by respective base stations. Each base station may include one or more base station antennas (BSAs) that are configured to provide two-way radio frequency ("RF") communications with mobile subscribers that are within the cell served by the base station. In many cases, each base station is divided into "sectors." In perhaps the most common configuration, a hexagonally shaped cell is divided into three 120° sectors, and each sector is served by one or more base station antennas. Typically, the base station antennas are mounted on a tower or other raised structure and the radiation patterns (a/k/a "antenna beams") are directed outwardly therefrom under RET control. These base station antennas are often implemented as linear or planar phased arrays of radiating elements. For example, as shown by FIG. 1B, a base station antenna 10' may include side-by-side columns of radiating elements ($RE_{11}$-$RE_{18}$, $RE_{21}$-$RE_{28}$), which define a pair of relatively closely spaced antennas A1 and A2. In this base station antenna 10', each column of radiating elements may be responsive to respective phase-shifted feed signals, which are derived from corresponding RF feed signals (FEED1, FEED2) and transmitters (TX1, TX2) and varied in response to computer control (CONTROL1, CONTROL2).

Moreover, due to the relatively high RF power transmitted from cellular base stations, the variable phase shifters used to generate the necessary phase shifts must be designed to handle the high RF power with minimal loss or impact to signal integrity. An additional requirement that typically drives the design of the phase shifters is the stringent passive intermodulation (PIM) performance that is required by any element in the signal path through the antenna. In the frequency division duplex (FDD) wireless systems commonly deployed for cellular systems, even extremely low levels of PIM can cause desensitization of the receiver due to intermodulation products produced from the transmitter signal that would fall into the receiver passband. Thus, all the elements of a base station antenna, including the variable phase shifters, should pass both the transmit and receive RF signals without desensitization of the base station receiver.

Both the high power handling requirements and PIM requirements placed on the phase shifters drive the design and construction of these elements. Often, these variable phase shifters are implemented as relatively large passive elements, which must be mechanically adjusted to set the appropriate phase shift or time delay. In many conventional systems, the mechanical actuation of these phase shifters is implemented using servo or stepper motors with mechanical linkages to the phase shifters.

However, because there are often many mechanically-actuated variable phase shifters in conventional multi-band base station antennas (BSAs), the size, cost, and complexity of the motors and mechanisms needed to implement variable phase shifts or time delays can be prohibitive. Accordingly, it would be advantageous to reduce the cost, size, and complexity of the variable phase shift or time delay function within a base station antenna without compromising the power handling, insertion loss, or PIM behavior of the radiation elements and other components.

FIGS. 2-3 illustrate examples of common configurations of variable phase shifters/time delay units 20, 30, which provide high power and low PIM operation. These phase shifters 20, 30 are frequently implemented as mechanical structures consisting of multiple overlapping transmission lines (TL1, TL2) on respective printed circuit boards (PCB1, PCB2). As will be understood by those skilled in the art, the time delay and phase shift associated with these devices is controlled by varying the length of transmission line overlap between PCB1 and PCB2. As the length of overlap increases, the total time delay decreases and vice versa. The transmission line movement is typically implemented as movement along an arc, which requires rotational actuation about a pivot point, as shown by FIG. 2, or lateral movement of a U-shaped transmission line (TL1), which requires linear actuation as shown by FIG.

In particular, FIG. 2 illustrates a phase shifter/time delay unit 20 having a first transmission line TL1 on PCB1, which is rotated in an arc opposite a second transmission line TL2 on PCB2. These transmission lines are typically coated with a dielectric material to produce a relatively high degree of capacitive coupling between TL1 and TL2. Thus, as PCB1 is rotated clockwise or counterclockwise, the electrical delay from the input signal port to the output signal port is varied. Likewise, in FIG. 3, a phase shifter/time delay unit 30 is shown as including a first U-shaped transmission line TL1 on PCB1, so that when it is moved laterally (e.g., left or right) over an underlying second transmission line TL2 on PCB2, the electrical delay from the input signal port to the output signal port is varied.

SUMMARY OF THE INVENTION

Base station antennas (BSAs) according to some embodiments of the invention include at least one feed signal phase shifter having a variable length signal path therein, which provides an adjustable signal delay in response to mechanical actuation thereof. A thermo-electric actuator is also provided, which is configured to support remote electrical tilt (RET) operations within a BSA by mechanically actuating the variable length signal path in response to an actuator drive signal. In some embodiments of the invention, the thermo-electric actuator includes a thermally-deformable component configured to receive the actuator drive signal. This thermally-deformable component may have a first shape when heated by the actuator drive signal to a temperature above a threshold temperature and a second different shape when cooled to a temperature below the threshold temperature. The first shape can be a contracted state and the second shape can be an uncontracted state, or vice versa.

In some embodiments of the invention, the thermally-deformable component may be a shape-memory alloy (SMA), which may be configured as an SMA spring (or wire), or a wax motor, for example. The SMA may be selected from a group consisting of Fe—Mn—Si, Cu—Zn—Al, Cu—Al—Ni and Ni—Ti alloys. The thermo-electric actuator may also include a bias spring having a first end connected to an opposing first end of the SMA spring. A second end of the bias spring and a second end of the SMA spring may be attached to respective anchors.

According to additional embodiments of the invention, the thermo-electric actuator includes a pair of thermally-deformable components, which are responsive to respective actuator drive signals and mechanically coupled together in an opposing pull-pull configuration. In addition, the at least one phase shifter may be configured as a plurality of phase shifters, which are mechanically linked together to thereby operate in unison with the thermo-electric actuator. In particular, the plurality of phase shifters may be mechanically linked by a rack to the thermo-electric actuator, and the thermo-electric actuator may include a plurality of thermally-deformable components (e.g., SMA springs) that engage the rack during phase shifter adjustment. In some of these embodiments, a first of the plurality of thermally-deformable components can be configured to pull the rack in a first direction in response to a first actuator drive signal and a second of the plurality of thermally-deformable components can be configured to pull the rack in a second opposing direction in response to a second actuator drive signal.

In addition, in further embodiments of the invention, the thermo-electric actuator may include a first pair of thermally-deformable components that are: (i) configured in an opposing pull-pull configuration, and (ii) independently actuated during non-overlapping first and second time intervals to thereby switch the variable length signal path between first and second signal path segments. The thermo-electric actuator may also include a second pair of thermally-deformable components, which are similarly configured in an opposing pull-pull configuration and independently actuated during the non-overlapping first and second time intervals to thereby switch the variable length signal path between third and fourth signal path segments. In these embodiments, the first and third signal path segments are electrically coupled end-to-end by a first transmission line segment and the second and fourth signal path segments are electrically coupled end-to-end by a second transmission line segment having different signal delay characteristics relative to the first transmission line segment.

In some additional embodiments of the invention, the first of the at least one phase shifter includes a plurality of phase-shifter stages, which are electrically coupled in series, with each of the plurality of phase-shifter stages including first and second pairs of thermally-deformable components therein. Preferably, the plurality of phase-shifter stages are binary-weighted to thereby provide 0° to 360°-N° phase shifts to RF signals, in N° increments.

According to additional embodiments of the invention, a base station antenna sub-assembly is provided, which includes: (i) a plurality of phase shifters having respective variable length signal paths therein that are mechanically linked together, and (ii) a thermo-electric actuator, which is configured to mechanically actuate the variable length signal paths in unison during a phase shifter adjustment operation. The plurality of phase shifters may be mechanically linked together and to the thermo-electric actuator by, for example, a rack. The thermo-electric actuator may include at least one thermally-deformable component (e.g., SMA alloy), which is responsive to a respective actuator drive signal that causes deformation thereof during the phase shifter adjustment operation. This deformation of the at least one thermally-deformable component can translate to movement of the rack.

According to still further embodiments of the invention, a base station antenna sub-assembly is provided, which includes at least one phase shifter configured to add/subtract a mechanically-adjustable delay to/from an input signal in response to movement of an element therein. A thermo-electric actuator is also provided, which may include a thermally-deformable component that is mechanically coupled to the element and responsive to an actuator drive signal. This actuator drive signal can be active during an operation to adjust an amount of the delay. In particular, the actuator drive signal can be active during an operation to adjust an amount of the delay in proportion to an amount of deformation of the thermally-deformable component.

In some further embodiments of the invention, the at least one phase shifter includes a first phase shifter having a plurality of binary-weighted stages therein, which are connected in series. In these embodiments of the invention, the thermo-electric actuator is distributed across the plurality of binary-weighted stages, with each of the plurality of binary-weighted stages including a plurality of thermally-deformable components therein.

According to still further embodiments of the invention, an antenna sub-assembly is provided, which includes a phase shifter having a plurality of serially-connected stages therein that provide a programmable time/phase delay to an applied radio frequency (RF) signal. This plurality of serially-connected stages can be binary-weighted to thereby provide a digitally programmable time/phase delay to the applied RF signal. In some of these embodiments, the plurality of serially-connected stages includes at least one thermally-deformable component, which can be actuated to thereby influence an amount of phase delay provided to the RF signal by the corresponding stage. This thermally-deformable component may include a shape-memory alloy (SMA).

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION OF EMBODIMENTS

Figure 1A:
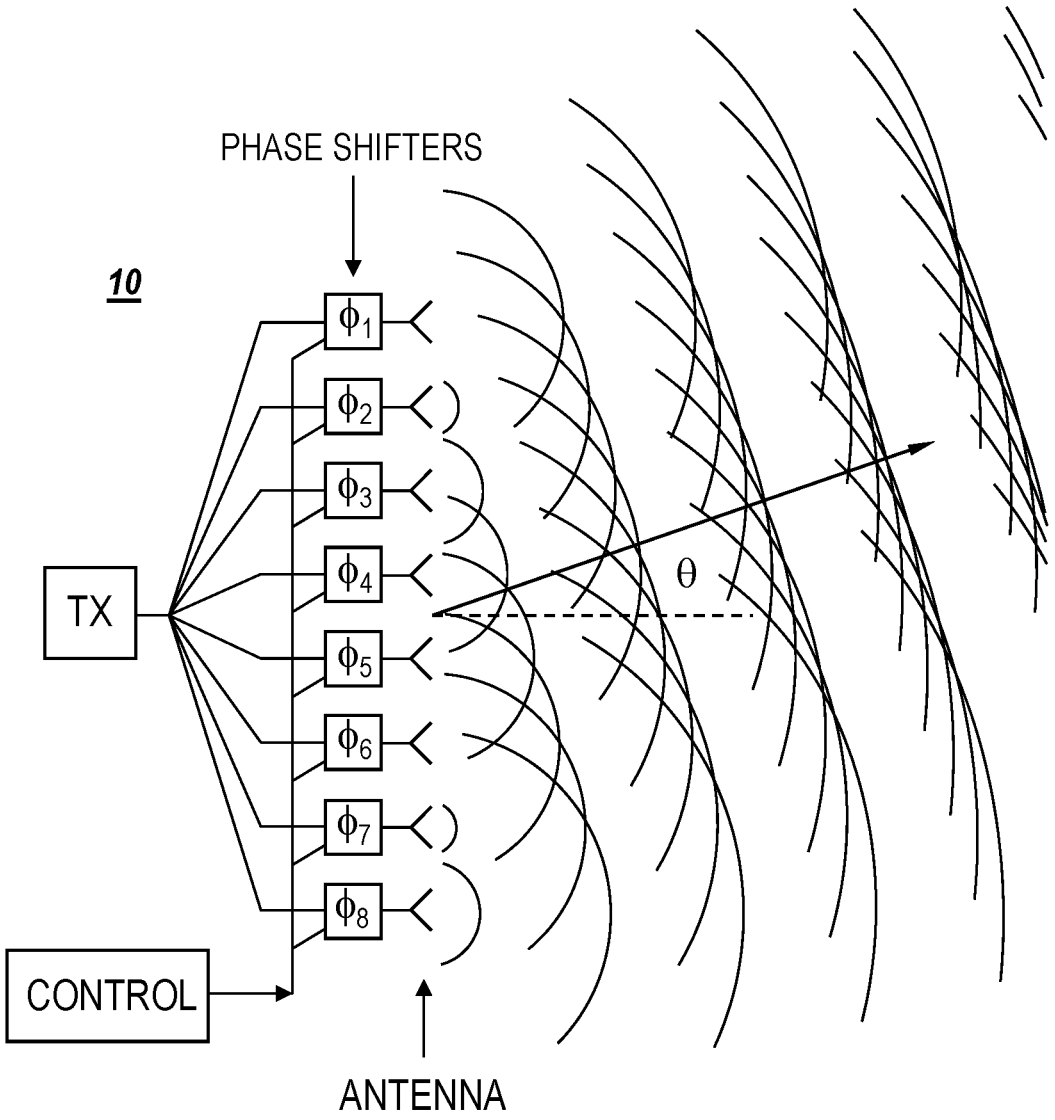
FIG. 1A (PRIOR ART)
FIG. 1A is a block diagram of a phased array antenna according to the prior art.
Figure 1B:
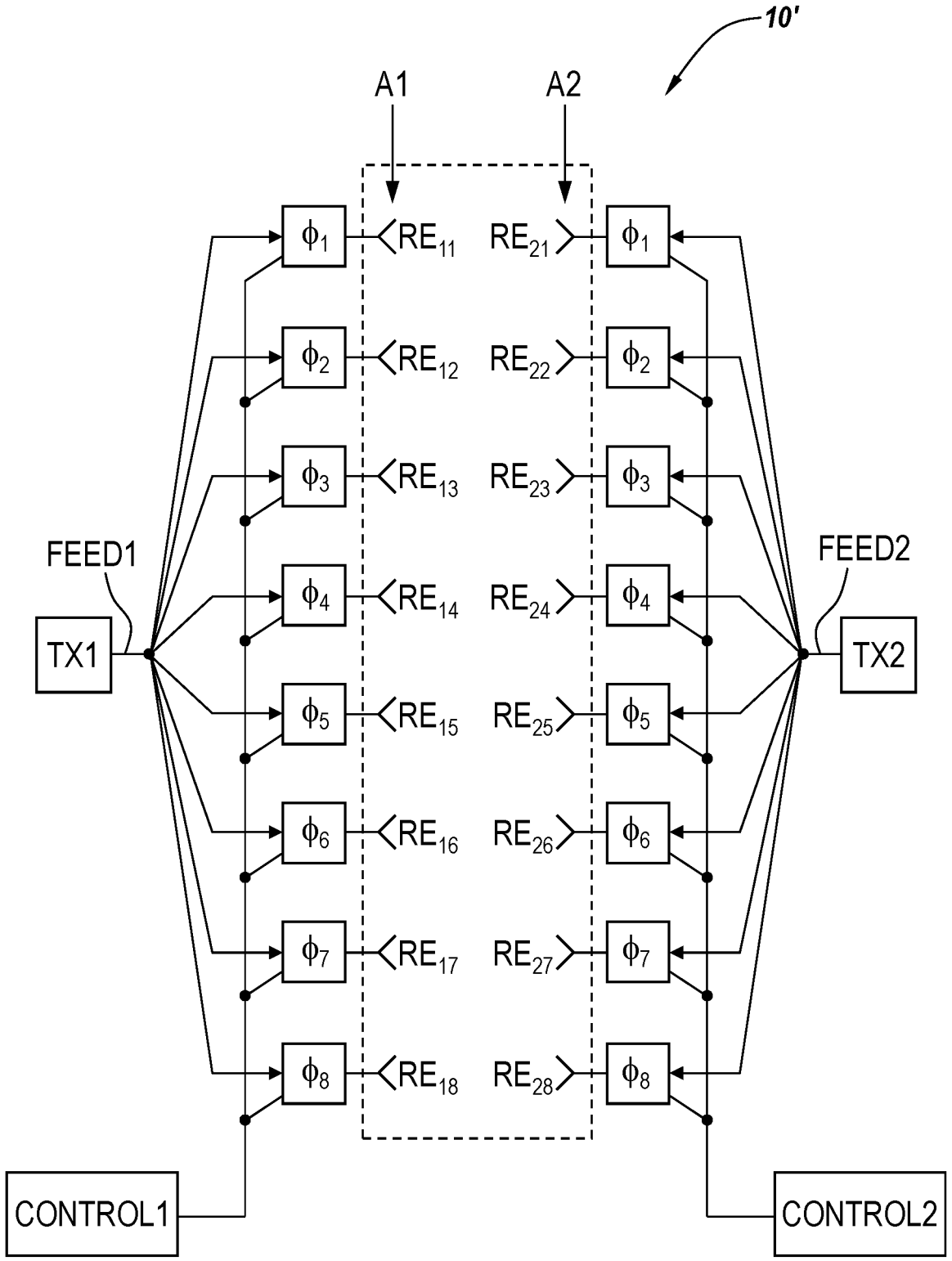
FIG. 1B (PRIOR ART)
FIG. 1B is a block diagram of a base station antenna (BSA) according to the prior art.
Figure 2:
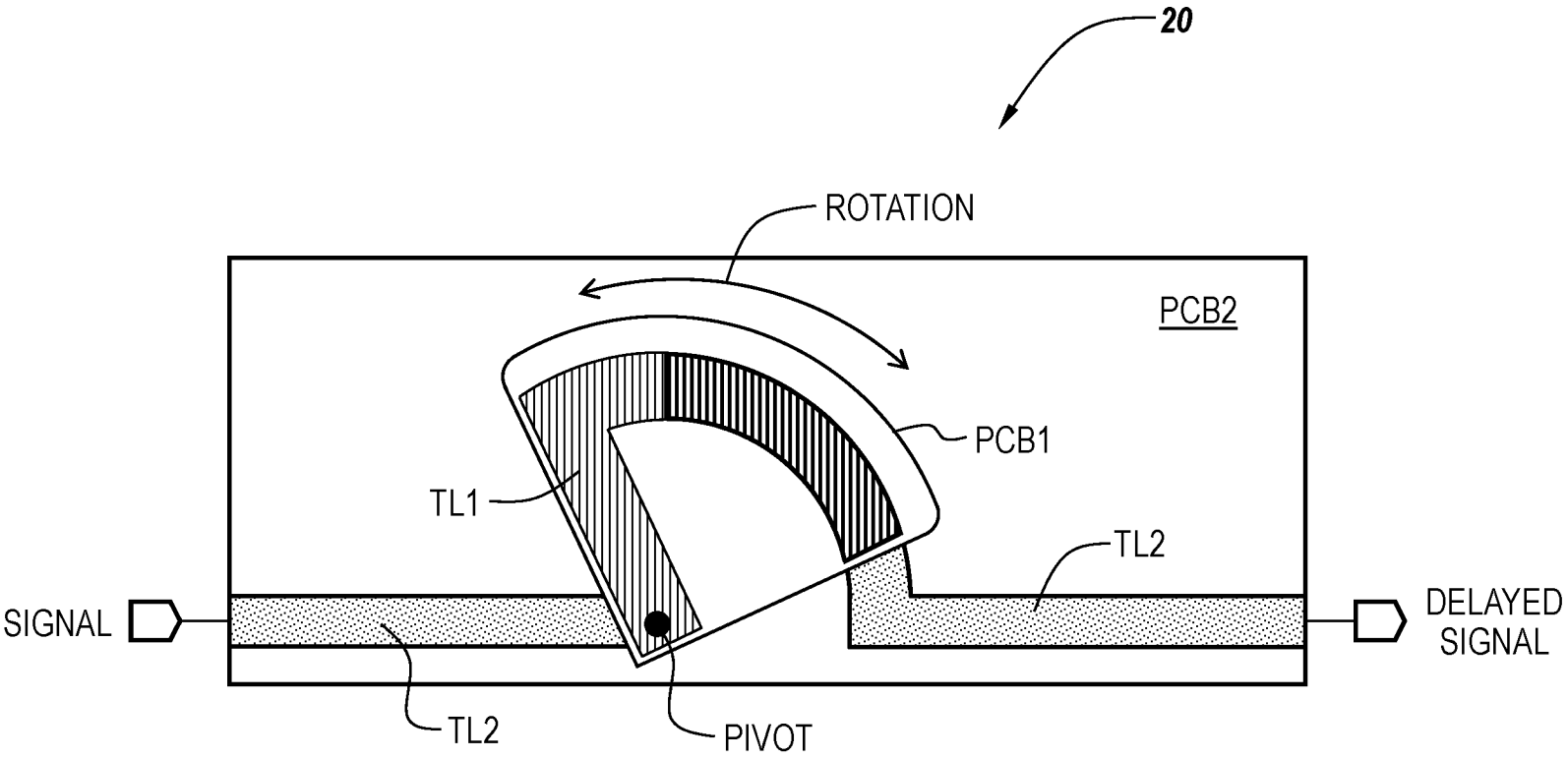
FIG. 2 (PRIOR ART)
FIG. 2 is a plan view of a conventional variable phase shifter/time delay unit, which utilizes arc rotation of a transmission line segment.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components and/or regions, these elements, components and/or regions should not be limited by these terms. These terms are only used to distinguish one element, component and/or region from another element, component and/or region. Thus, a first element, component and/or region discussed below could be termed a second element, component and/or region without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Figure 4:
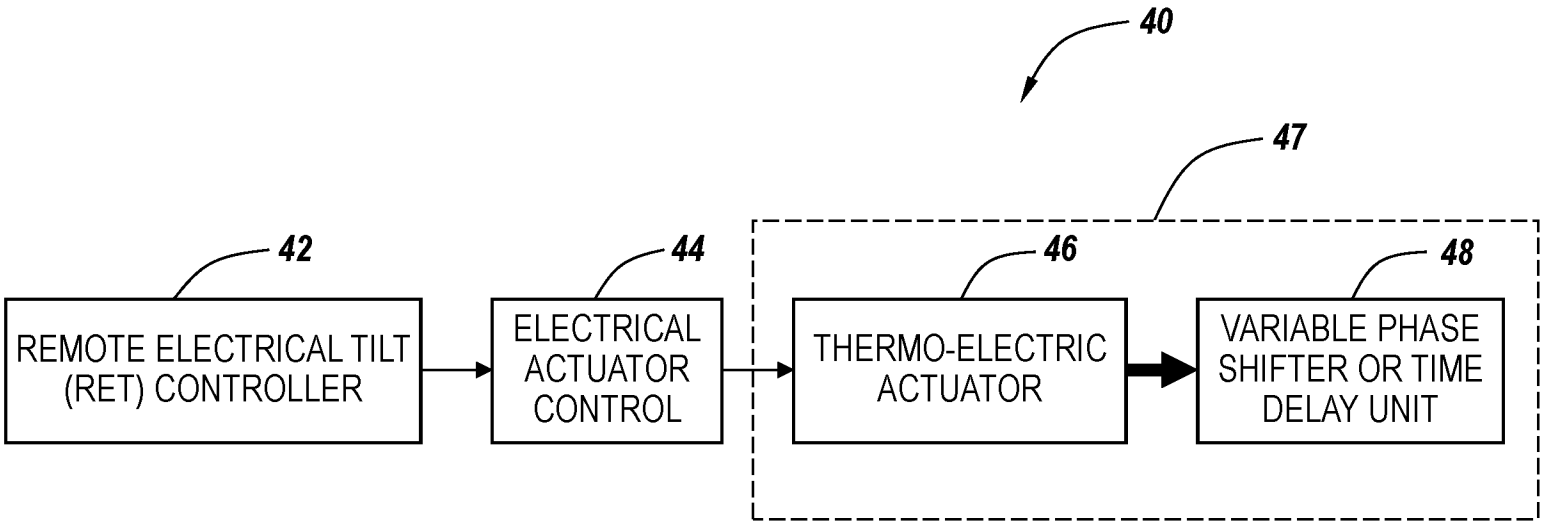
FIG. 4 is a block diagram of a system for providing remote electrical tilt (RET) in a base station antenna, according to an embodiment of the invention.

Referring now to FIG. 4, a system 40 for providing remote electrical tilt (RET) functionality to a base station antenna is illustrated as including an RET controller 42, which controls, among other things, an actuator control circuit 44. This actuator control circuit provides control and drive signals to a thermo-electric actuator 46. As described more fully hereinbelow, the thermo-electric actuator 46 is mechanically coupled to one or more variable phase shifters/time delay units 48 within a base station antenna (BSA) sub-assembly 47. These variable phase shifters/time delay units 48 are mechanically controlled by the thermo-electric actuator 46 in order to achieve a desired phase shift/time delay. The movement of the thermo-electric actuator 46 is achieved by a repeated heating and cooling process, which causes deformation in the form of material expansion and contraction in order to ultimately induce linear or rotational motion in the variable phase shifters/time delay units 48. The actuator control circuit 44 is used to switch the appropriate current or voltage level to the thermo-electric actuator 46 at an interval and duration that is appropriate to cause the desired degree of motion. The actuator control circuit 44 is controlled by the antenna RET controller 42 as it receives commands to tilt an antenna beam to a prescribed angle (via adjustment of the settings for the variable phase shifters/time delay units 48).

Figure 5A:
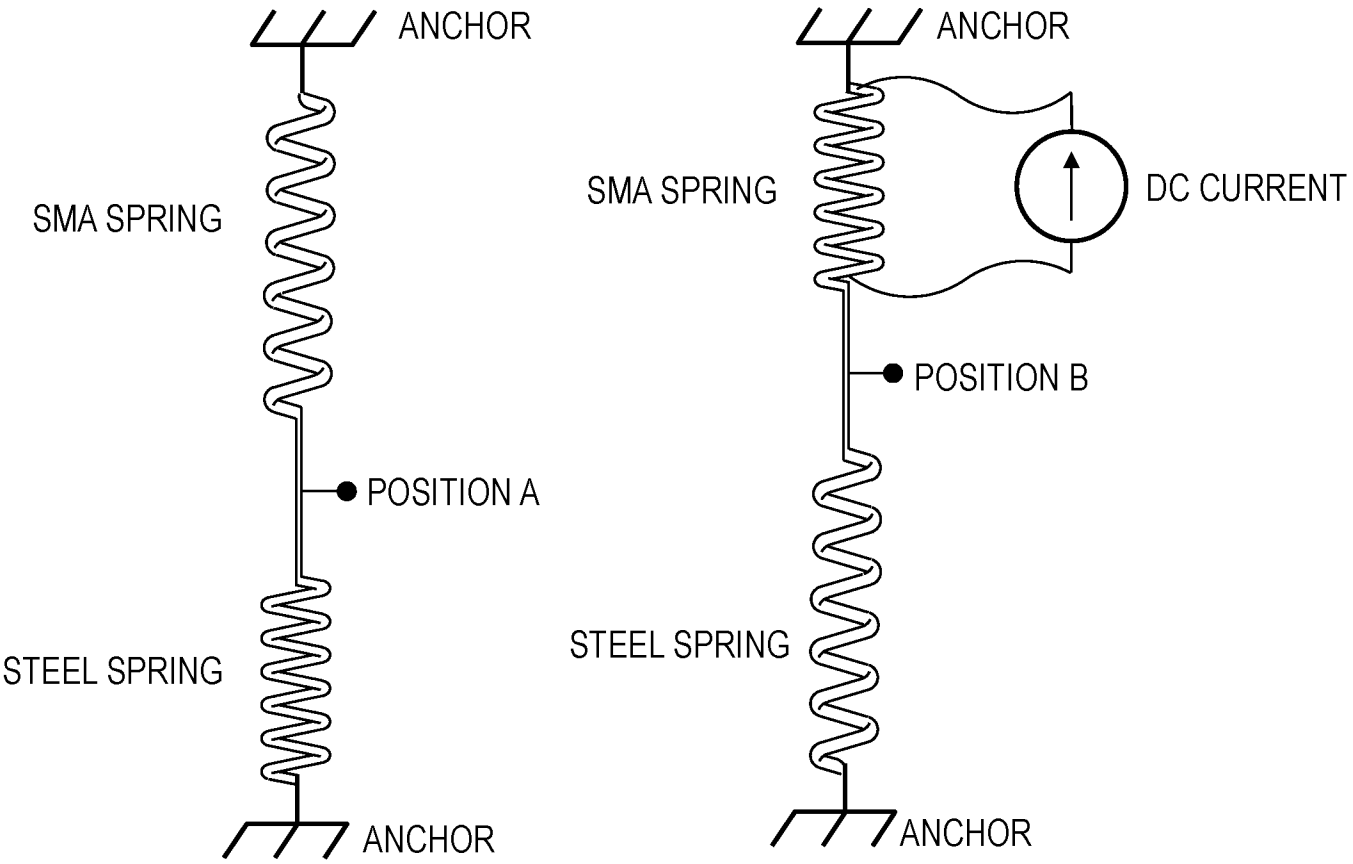
FIG. 5A is a schematic diagram that illustrates contraction of a shape-memory alloy (SMA) spring when heated by a DC current.
Figure 5B:
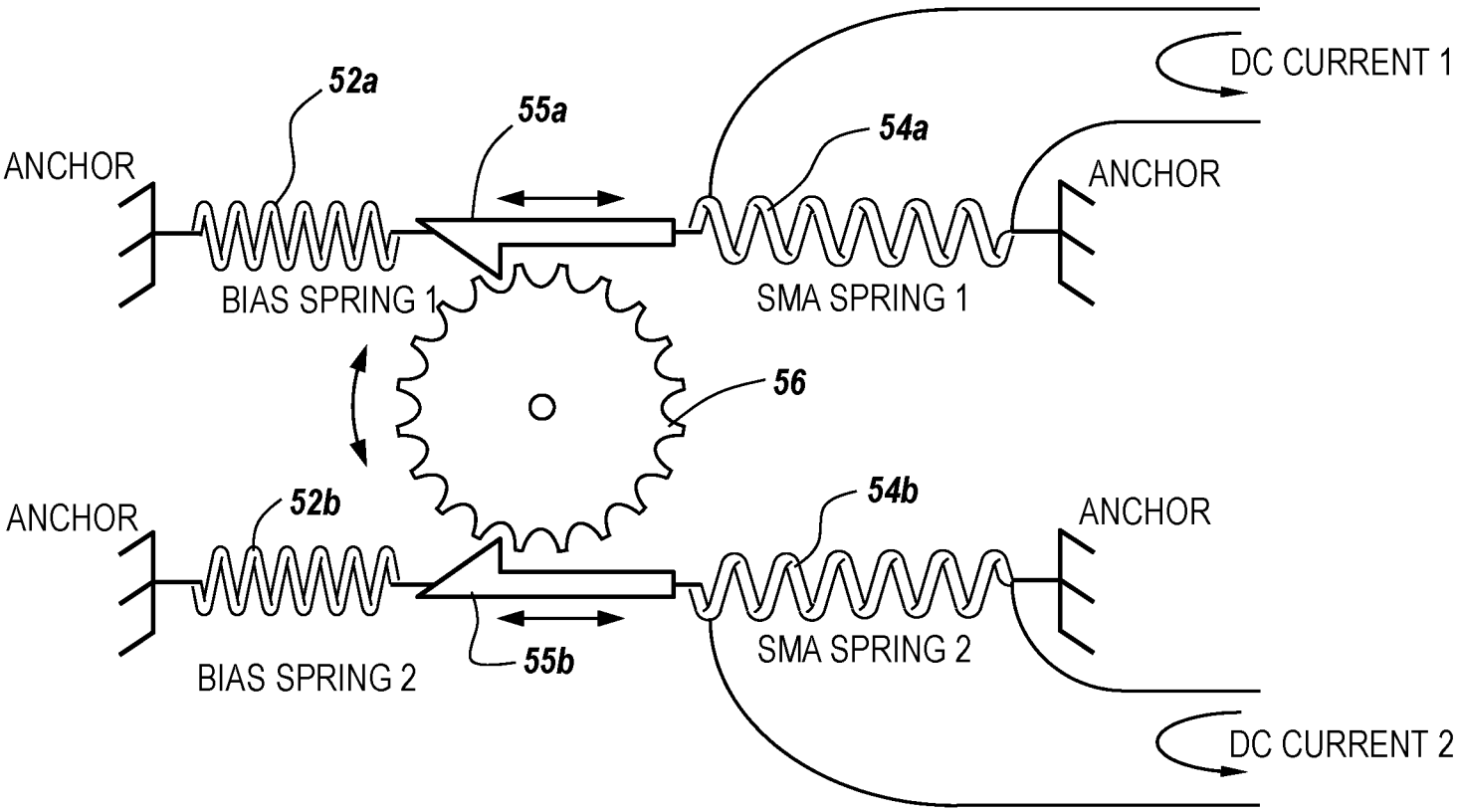
FIG. 5B is a schematic diagram that illustrates clockwise and counterclockwise rotation of a sprocket using a pair of SMA springs that are heated by respective DC currents during nonoverlapping time intervals, according to an embodiment of the invention.
Figure 5C:
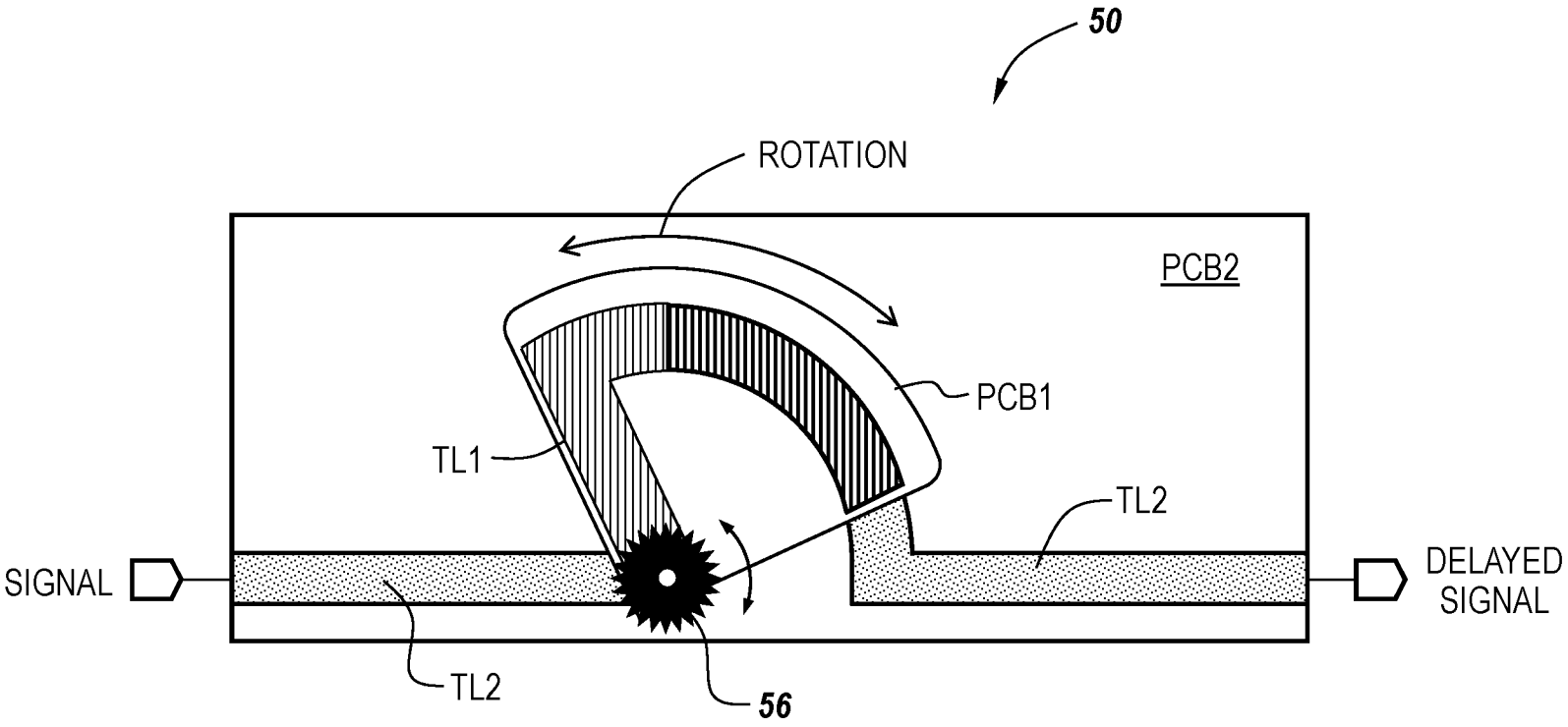
FIG. 5C is a plan view of a variable phase shifter/time delay unit, which utilizes arc rotation of a transmission line segment using the sprocket (and SMA springs, not shown) of FIG. 5B, according to an embodiment of the invention.

A base station antenna (BSA) sub-assembly 47 according to an embodiment of the invention is illustrated by FIGS. 5A-5C. In this embodiment, a coil spring formed from a shape-memory alloy (SMA) having "one-way memory" may operate as a thermo-electric actuator. However, in alternative embodiments of the invention, the coil spring may be replaced by an SMA wire or other type of spring configuration such as a leaf spring, compression spring, extension spring, spring clip, torsion spring or other type of spring mechanism capable of inducing a force.

As will be understood by those skilled in the art, a shape-memory alloy (SMA) material is an alloy that can be deformed from its original shape by external forces (while at a temperature below the alloy's transition temperature), but return to its original shape once heated to a temperature above the alloy's transition temperature. Moreover, while iron and copper based SMAs, such as Fe—Mn—Si, Cu—Zn—Al and Cu—Al—Ni, may be used to provide "one-way memory", SMAs formed from nickel-titanium (NiTi) alloys may be preferred in some embodiments due to their superior stability and thermo-mechanical performance. NiTi alloys change between two different phases upon cooling. These two phases are austenite and martensite phases. The martensite temperature is the temperature at which the transition to the martensite phase takes place upon cooling. In contrast, during heating, the austenite temperature range is the range of temperature over which the transformation from martensite to austenite phase starts and finishes.

Some SMAs exhibit a one-way memory effect, whereas other SMAs can exhibit a two-way memory effect. When a shape-memory alloy having a one-way memory effect is in its cold state, the alloy can be bent or stretched and will hold the deformed shapes until heated above the transition temperature. Upon heating, the shape changes to its original shape and remains in this original shape during subsequent cooling until deformed again. Thus, with SMAs having a one-way memory effect, cooling from high temperatures does not cause a shape change. Instead, a deformation force must be applied in order to return the alloy to an alternate shape at low temperatures. In contrast, the two-way memory effect is the effect that the material has two different reference shapes. The material returns to one reference shape at low temperatures below a transition temperature and to another shape at temperatures above a transition temperature. This effect can be exhibited without the application of an external force, as is required with the one-way memory effect.

Referring now to the left side of FIG. 5A, an SMA spring and steel bias spring may be connected in series (between respective anchors), with position "A" designating the location of a point of interconnection between opposing ends of the SMA spring and bias spring. In contrast, as shown on the right side of FIG. 5A, position "B", which is vertically displaced relative to position "A", may be enabled by heating the SMA spring with a DC current to thereby cause a contraction of the SMA spring to its "memory" state once a threshold temperature has been exceeded. As will be understood by those skilled in the art, the point of interconnection will return from position "B" to position "A" by virtue of a "pulling" force exerted by the bias spring, once the DC current is removed and the SMA spring is allowed to cool through conduction (e.g., via a heat sink) and/or convection to an ambient temperature. Accordingly, by scaling the dimensions and shape of the SMA spring in combination with the tension of the steel bias spring and the magnitude, duration and frequency of the DC current applied during heating (followed by cooling), a SMA-based electro-mechanical actuator can be used to create linear or rotational motion over predetermined actuation ranges.

As shown by FIGS. 5B-5C, the principles of electro-mechanical actuation illustrated by FIG. 5A can be utilized to support RET by providing efficient, low-cost and light-weight electro-mechanical control of a variable phase shifter. For example, as shown by FIG. 5B, a pair of steel bias springs 52*a*, 52*b* may be attached to a corresponding pair of SMA springs 54*a*, 54*b* by a pair of movable actuation levers 55*a*, 55*b*, which can selectively engage and cause rotation of a central sprocket 56 during non-overlapping time intervals. In particular, the application of a first DC current to the first SMA spring 54*a* will induce a contraction in its length, a corresponding left-to-right movement of the upper actuation lever 55*a* and a clockwise rotation of the sprocket 56. The termination of the first DC current and sufficient cooling of the first SMA spring 54*a* will cause an expansion in its length by virtue of the "pulling force" provided by the first bias spring 52*a*, and a left moving reset of the upper actuation lever 55*a*. Likewise, the application of a second DC current to the second SMA spring 54*b* will induce a contraction in its length, a corresponding left-to-right movement of the lower actuation lever 55*b* and a counterclockwise rotation of the sprocket 56. The termination of the second DC current and sufficient cooling of the second SMA spring 54*b* will cause an expansion in its length by virtue of the "pulling force" provided by the second bias spring 52*b*, and a left moving reset of the lower actuation lever 55*b*. In this manner, repeated cycling of the first DC current can be utilized to cause step-by-step clockwise rotation of the sprocket 56, whereas repeated cycling of the second DC current can be utilized to cause step-by-step counterclockwise rotation of the sprocket 56.

As shown by FIG. 5C, this sprocket 56 may be a component of an "arc rotation" phase shifter 50, which includes a pair of printed circuit board PCB1, PCB2 and capacitively coupled transmission line segments TL1, TL2, which collectively operate to a delay an input feed signal by a desired amount of delay that is set by electro-mechanical actuation of the sprocket 56, which is mounted to a pivot point of the rotating board.

Figure 6A:
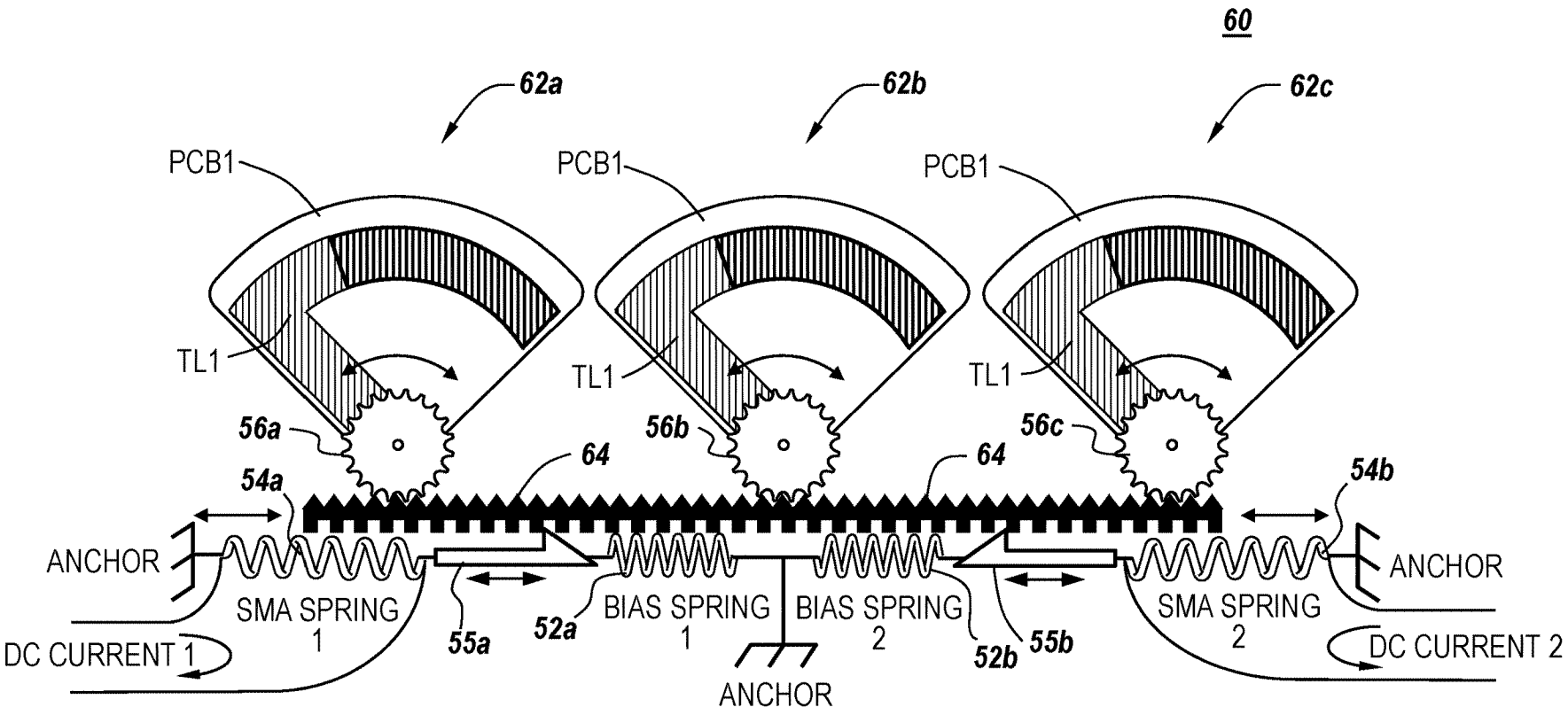
FIG. 6A is a plan view of a base station antenna (BSA) sub-assembly containing a plurality of phase shifters and thermo-electric actuator, according to an embodiment of the invention.

Referring now to FIG. 6A, a base station antenna (BSA) sub-assembly 60 is illustrated as containing a plurality of "arc rotation" phase shifters 62*a*, 62*b* and 62*c*, which contain respective pairs of printed circuit boards (lower boards PCB2 shown in FIG. 5C) and corresponding sprockets 56*a*, 56*b* and 56*c*. These sprockets 56*a*, 56*b* and 56*c* are mechanically coupled to each other by a horizontal rack 64, which is illustrated as a dual-sided cogged/toothed rail. A thermo-electric actuator is also illustrated as including first and second SMA springs 54*a*, 54*b*, first and second bias springs 52*a*, 52*b* and left and right laterally movable actuation levers 55*a*, 55*b*, which are collectively configured to mechanically actuate each of the variable length signal paths within the phase shifters 62*a*, 62*b* and 62*c*. Because it is common to produce multiple different time delays or phase shifts that are varied proportionally during RET-based phase shifter adjustment operations, the actuation of multiple phase shifters from a single thermo-electro actuator can be advantageous.

In particular, during each phase shifter adjustment operation, a first DC current may be applied to contract the first SMA spring 54*a* and thereby cause a right-to-left movement of the left actuation lever 55*a* (and rack 64) and a corresponding clockwise rotation of the sprockets 56*a*, 56*b* and 56*c*, which leads to a reduction in the signal delays provided by the phase shifters 62*a*, 62*b* and 62*c*. Alternatively, a second DC current may be applied to contract the second SMA spring 54*b* and thereby cause a left-to-right movement of the right actuation lever 55*b* (and rack 64) and a corresponding counterclockwise rotation of the sprockets 56*a*, 56*b* and 56*c*, which leads to an increase in the signal delays provided by the phase shifters 62*a*, 62*b* and 62*c*. The first and second bias springs 52*a* and 52*b* also support the respective left-to-right movement of the left actuation lever 55*a* (and expansion of the first SMA spring 54*a* when the first DC current is terminated) and the right-to-left movement of the right actuation lever 55*b* (and expansion of the second SMA spring 54*b* when the second DC current is terminated).

Figure 3:
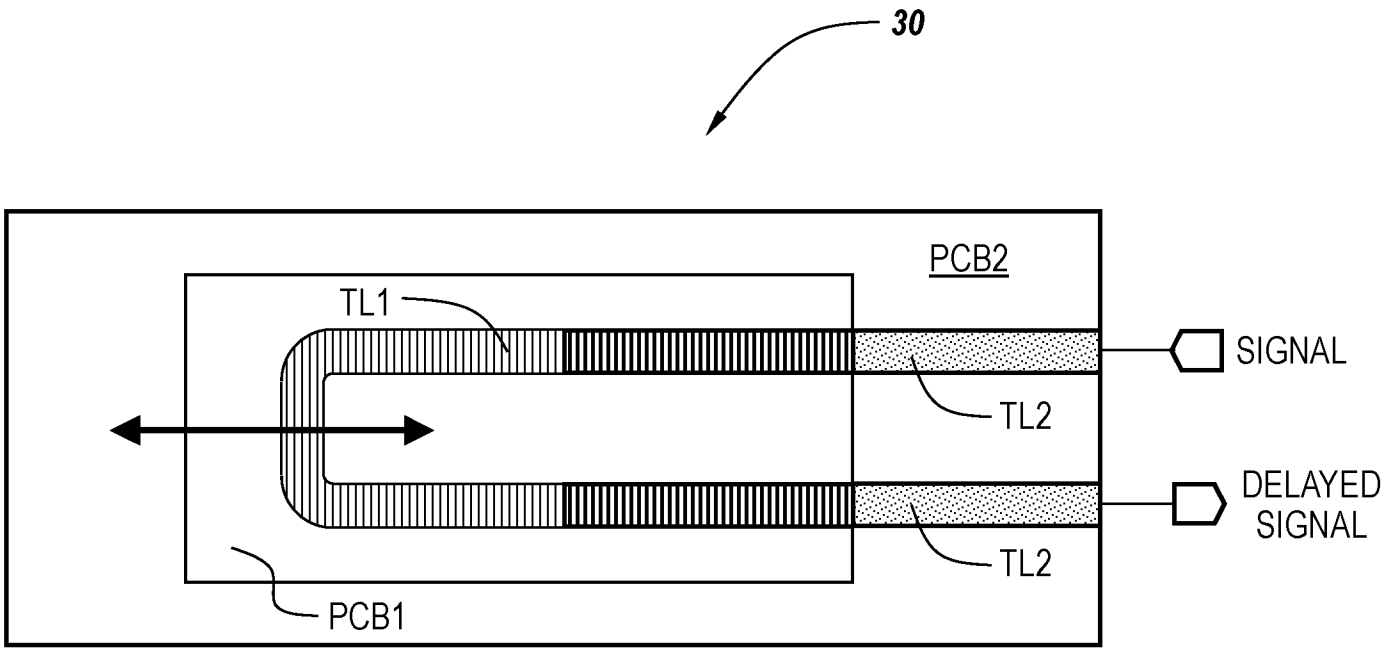
FIG. 3 (PRIOR ART)
FIG. 3 is a plan view of a conventional variable phase shifter/time delay unit, which utilizes lateral movement of a U-shaped transmission line segment.
Figure 6B:
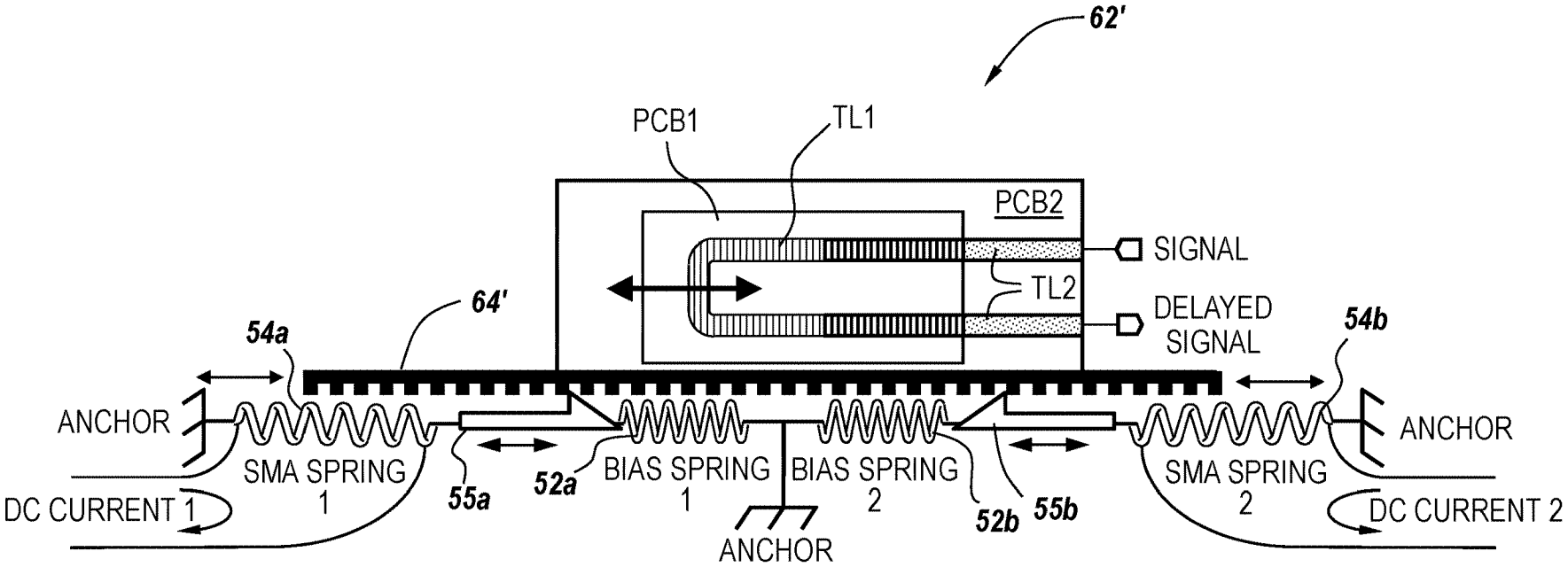
FIG. 6B is a plan view of a base station antenna (BSA) sub-assembly containing a phase shifter and thermo-electric actuator, according to an embodiment of the invention.

As shown by FIG. 6B, the operations of the thermo-electric actuator of FIG. 6A may be utilized in combination with a "lateral" phase shifter 62', which was previously described hereinabove with respect to FIG. 3, and elongate rack 64'. Accordingly, a first DC current may be applied to the first SMA spring 54*a* to thereby cause a right-to-left movement of the left actuation lever 55*a* (and rack 64') and a corresponding right-to-left movement of the "upper" first printed circuit board PCB1 (and U-shaped transmission line TL1) relative to the stationary second printed circuit PCB2, which leads to an increase in the signal delay provided by the "lateral" phase shifter 62'. Likewise, a second DC current may be applied to the second SMA spring 54*b* to thereby cause a left-to-right movement of the right actuation lever 55*b* (and rack 64') and a corresponding left-to-right movement of the "upper" first printed circuit board PCB1 (and U-shaped transmission line TL1) relative to the "lower" second printed circuit PCB2, which leads to a decrease in the signal delay provided by the "lateral" phase shifter 62'. The first and second bias springs 52*a* and 52*b* also support the respective left-to-right movement of the left actuation lever 55*a* (and expansion of the first SMA spring 54*a* when the first DC current is terminated) and the right-to-left movement of the right actuation lever (and expansion of the second SMA spring 54*b* when the second DC current is terminated.

Figure 7:
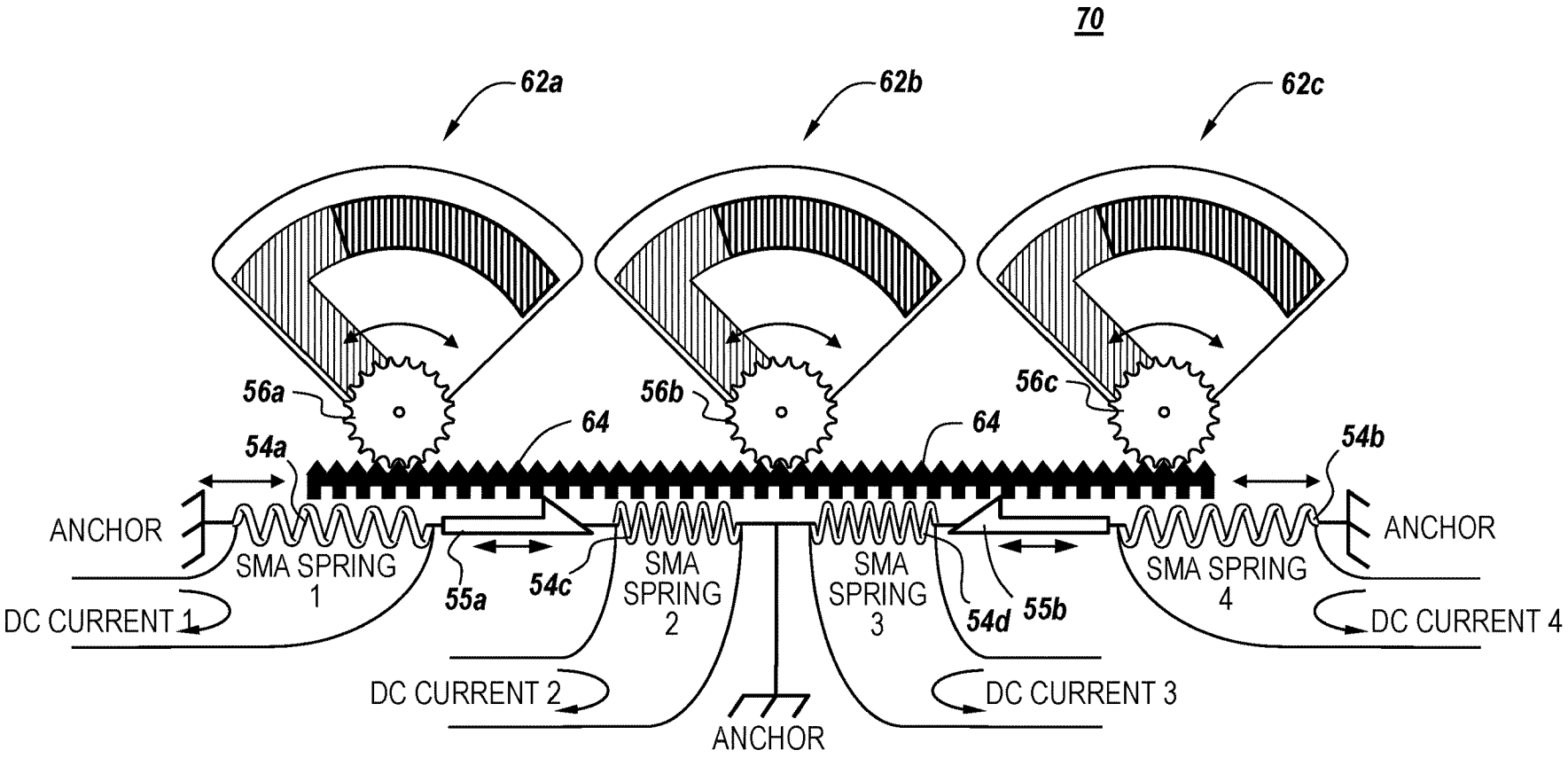
FIG. 7 is a plan view of a base station antenna (BSA) sub-assembly containing a plurality of phase shifters and thermo-electric actuator, according to an embodiment of the invention.

Referring now to FIG. 7, a base station antenna (BSA) sub-assembly 70 is illustrated as containing a plurality of "arc rotation" phase shifters 62*a*, 62*b* and 62*c*, which contain respective pairs of printed circuit boards (lower boards PCB2 shown in FIG. 5C) and corresponding sprockets 56*a*, 56*b* and 56*c*. These sprockets 56*a*, 56*b* and 56*c* are mechanically coupled to each other by a horizontal rack 64, which is illustrated as a dual-sided cogged/toothed rail. A thermo-electric actuator is also illustrated as including four SMA springs 54*a*, 54*b*, 54*c* and 54*d* and left and right laterally movable actuation levers 55*a*, 55*b*, which are collectively configured to mechanically actuate the variable length signal paths within the phase shifters 62*a*, 62*b* and 62*c* during an RET-based phase shifter adjustment operation.

In particular, during a phase shifter adjustment operation, first and second DC currents may be applied in an alternating sequence (in repeating cycles) to initially contract the first SMA spring 54*a* and then contract the second SMA spring 54*c*, and thereby cause a right-to-left movement of the left actuation lever 55*a* followed by a return left-to-right movement of the left actuation lever 55*a* (for each cycle). Each right-to-left movement of the left actuation lever 55*a* causes an incremental right-to-left movement of the rack 64 and corresponding incremental clockwise rotation of the sprockets 56*a*, 56*b* and 56*c*, which leads to a reduction in the signal delays provided by the phase shifters 62*a*, 62*b* and 62*c*. Alternatively, fourth and third DC currents may be applied in an alternating sequence (in repeating cycles) to initially contract the fourth SMA spring 54*b* and then contract the third SMA spring 54*d*, and thereby cause a left-to-right movement of the right actuation lever 55*b* followed by a return right-to-left movement of the right actuation lever 55*b* (for each cycle). Each left-to-right movement of the right actuation lever 55*b* causes an incremental left-to-right movement of the rack 64 and corresponding incremental counterclockwise rotation of the sprockets 56*a*, 56*b* and 56*c*, which leads to an increase in the signal delays provided by the phase shifters 62*a*, 62*b* and 62*c*. As shown, the first and second SMA springs 54*a*, 54*c* are coupled together (via the left actuation lever 55*a*) in a pull-pull configuration so that opposing lateral forces can be applied to the left actuation lever 55*a* during non-overlapping time intervals. Similarly, the third and fourth SMA springs 54*d*, 54*b* are coupled together (via the right actuation lever 55*b*) in a pull-pull configuration so that opposing lateral forces can be applied to the right actuation lever 55*a* during non-overlapping time intervals.

Figure 8A:
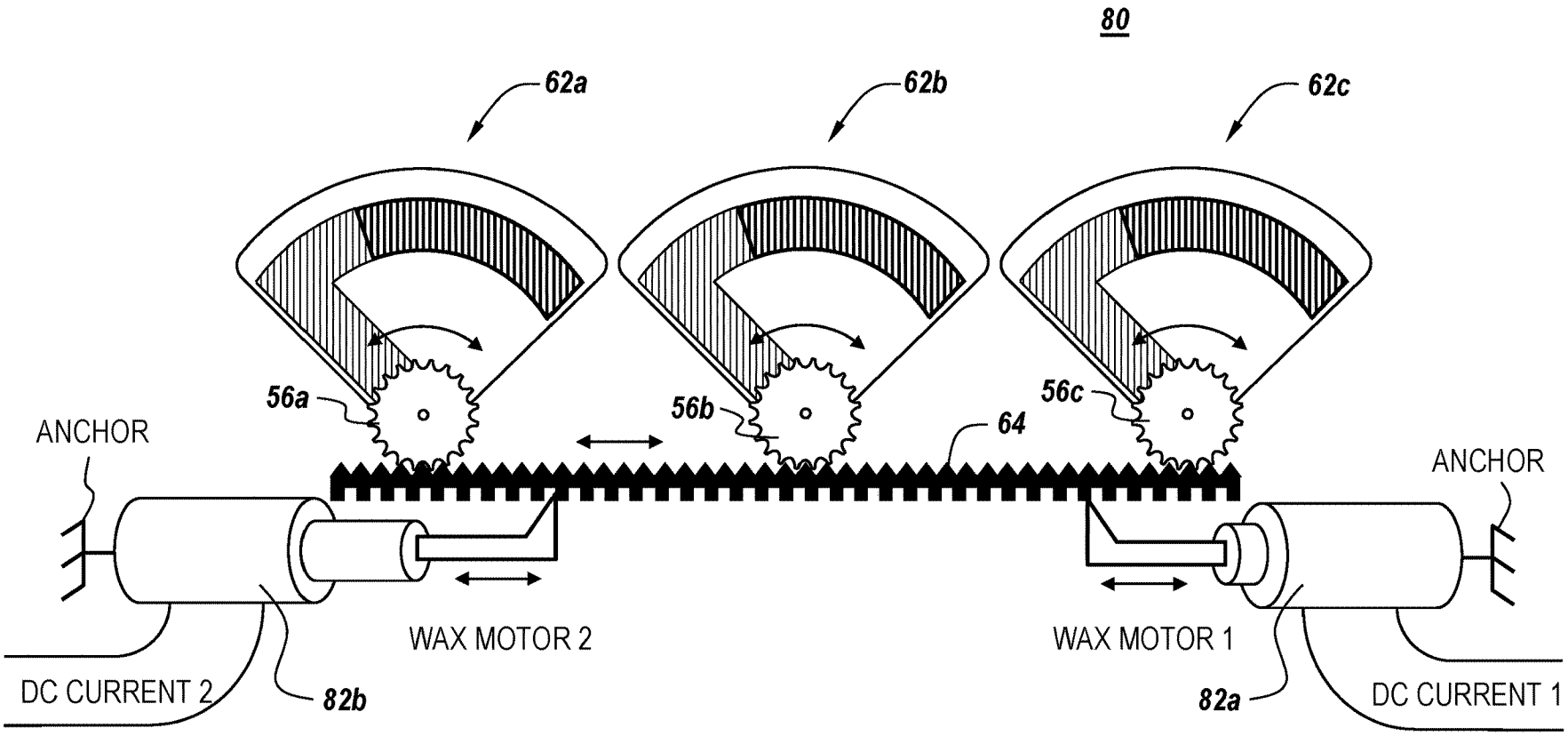
FIG. 8A is a plan view of a base station antenna (BSA) sub-assembly containing a plurality of phase shifters and thermo-electric actuator, according to an embodiment of the invention.
Figure 8B:
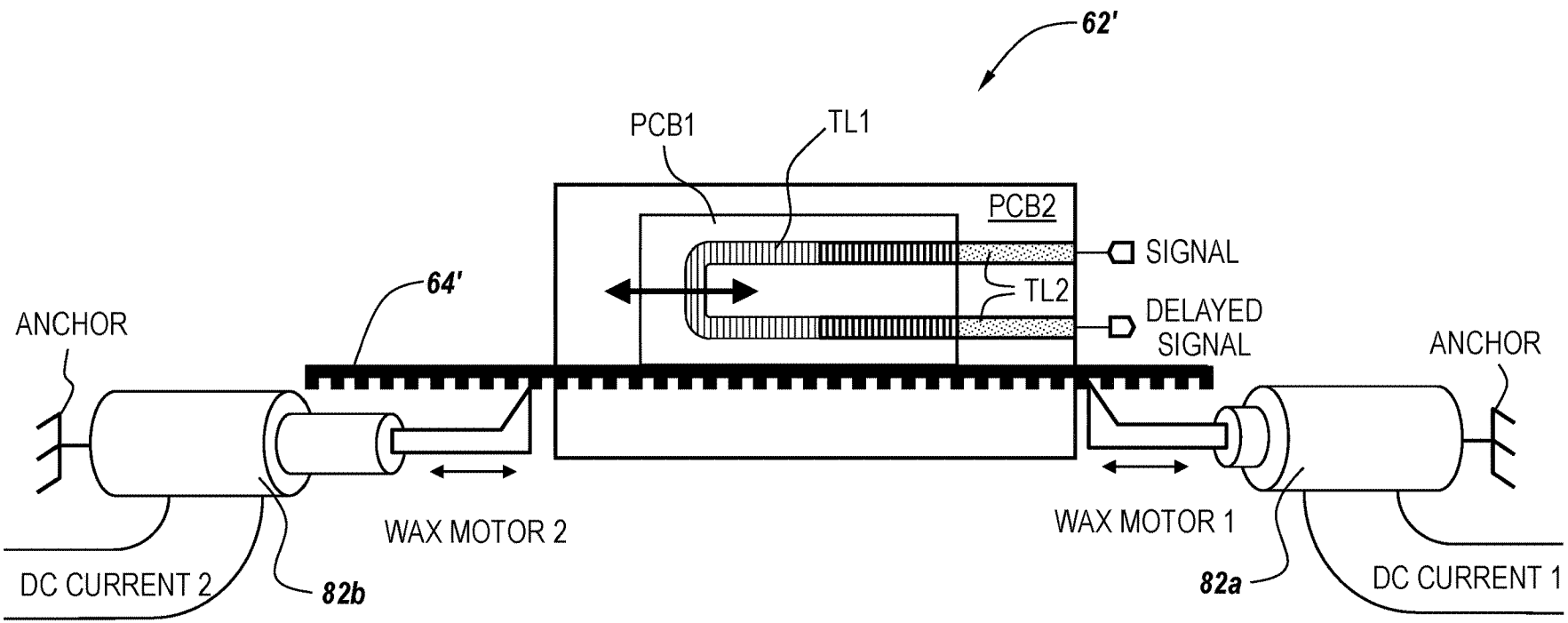
FIG. 8B is a plan view of a base station antenna (BSA) sub-assembly containing a phase shifter and thermo-electric actuator, according to an embodiment of the invention.

FIG. 8A illustrates a modified base station antenna (BSA) sub-assembly 80, which is similar to the sub-assemblies 60, 70 illustrated by FIGS. 6A and 7; and FIG. 8B illustrates a base station sub-assembly that is similar to the sub-assembly illustrated by FIG. 6B. However, the spring-based elements for performing thermo-electric actuation, as shown by FIGS. 6A-6B and 7, are replaced with wax motors 82*a*, 82*b*. These wax motors function as linear actuator devices that convert thermal energy (from applied DC currents 1, 2) into mechanical energy by exploiting the phase-change behavior of waxes. These wax motors 82*a*, 82*b* contain a housing with an internal piston, which is either extended by electrically heating and expanding an internal wax core or is retracted by allowing the wax core to cool and contract. Accordingly, the repeated application of a first DC current to the first wax motor 82*a* (with no second DC current to the second wax motor 82*b*) can be used to cause incremental right-to-left movement of the racks 64, 64' (and clockwise rotation of the sprockets 56*a*, 56*b* and 56*c*). Alternatively, the repeated application of a second DC current to the second wax motor 82*b* (with no first DC current to the first wax motor 82*a*) can be used to cause incremental left-to-right movement of the racks 64, 64' (and counterclockwise rotation of the sprockets 56*a*, 56*b* and 56*c*).

Referring now to FIGS. 9 and 10A-10C, a high power phase shifter assembly 90 for a base station antenna (BSA) will be described, which utilizes a thermo-electric actuator that is distributed across multiple stages of the assembly 90. In particular, the phase shifter assembly 90 can utilize multiple binary-weighted and serially-connected phase-shifting stages: (92*a*, 92*b*), (92*c*, 92*d*), (92*e*, 92*f*), (92*g*, 92*h*) and (92*i*, 92*j*) to thereby provide a multi-bit programmable time delay to a radio frequency (RF) input signal (RF_IN). As will be understood by those skilled in the art, a time delay produces a concomitant phase delay to an RF signal that is dependent on the frequency of the RF signal. Thus, as described herein, every reference to phase shift and phase delay can be interpreted as a form of time delay and vice versa.

Figure 9:
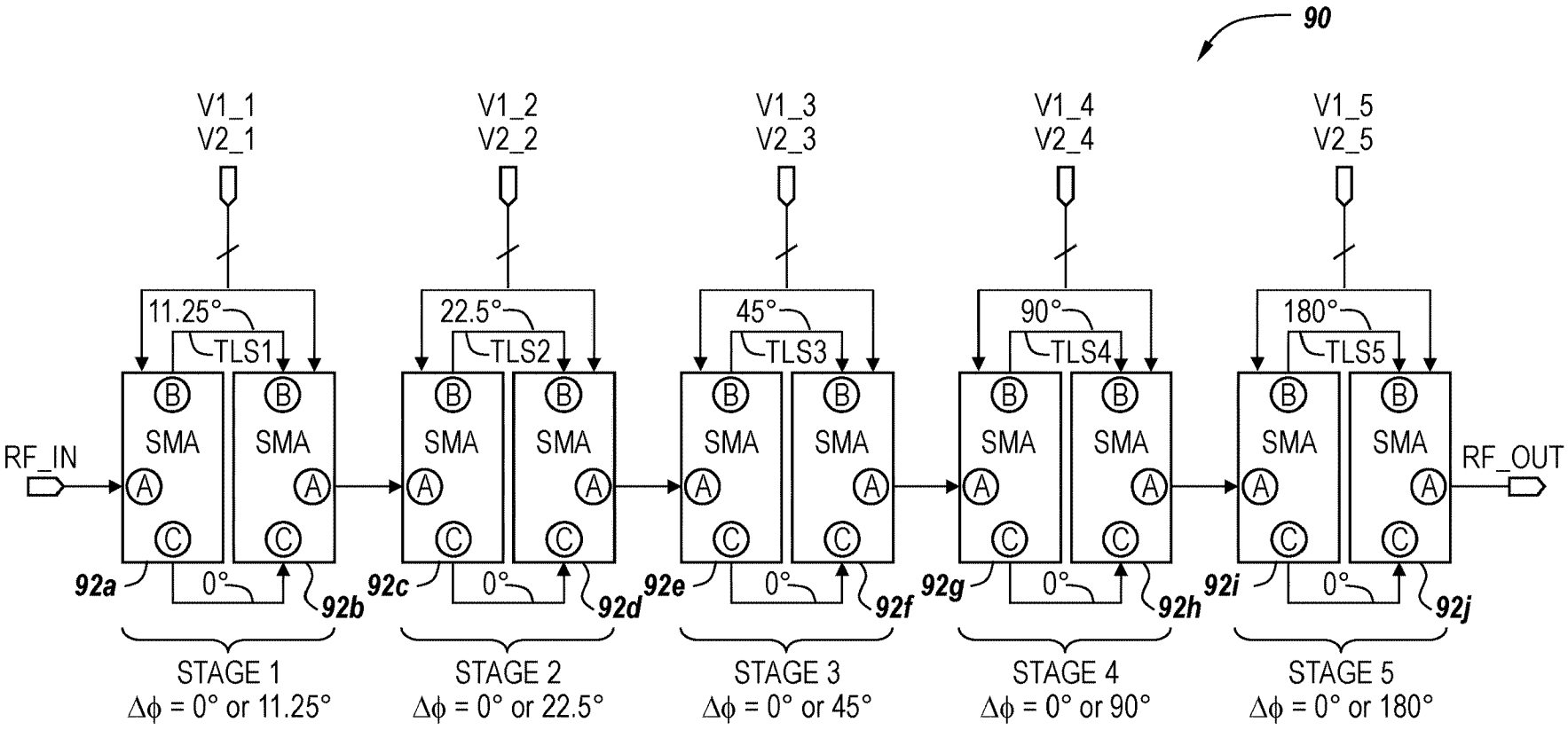
FIG. 9 is a block diagram of a phase shifter assembly for a base station antenna (BSA), which utilizes multiple binary-weighted and serially-connected phase-shifting stages to provide a multi-bit programmable time/phase delay to a radio frequency (RF) input signal, according to an embodiment of the present invention.

As shown by FIG. 9, the multi-bit programmable time/phase delay can be established by five (5) pairs of actuator drive signals: (V1_1, V2_1), (V1_2, V2_2), (V1_3, V2_3), (V1_4, V2_4) and (V1_5, V2_5), with each pair of signals having respective magnitudes that translate to digital values of either (1,0) or (0,1) to thereby enable/disable a corresponding portion of a multi-stage delay path through the phase shifter assembly 90.

The first phase-shifting stage of FIG. 9 includes two "SMA switch" half-stages 92*a*, 92*b*, which are responsive to a first pair of actuator drive signals (V1_1, V2_1) and collectively provide a phase delay of 0° or 11.25° depending on which of three port connections (A→B→A, or A→C→A) are enabled through interconnecting transmission line segments having unequal delay characteristics (e.g., unequal electrical lengths to RF signals). In particular, when port connections A→B→A are enabled within the first phase-shifting stage, then the first interconnecting transmission line segment TLS1 will provide a 11.25° phase delay. The second phase-shifting stage includes two half-stages 92*c*, 92*d*, which are responsive to a second pair of actuator drive signals (V1_2, V2_2) and collectively provide a phase delay of 0° or 22.5° (via second interconnecting transmission line segment TLS2). The third phase-shifting stage includes two half-stages 92*e*, 92*f*, which are responsive to a third pair of actuator drive signals (V1_3, V2_3) and collectively provide a phase delay of 0° or 45° (via third interconnecting transmission line segment TLS3). The fourth phase-shifting stage includes two half-stages 92*g*, 92*h*, which are responsive to a fourth pair of actuator drive signals (V1_4, V2_4) and collectively provide a phase delay of 0° or 90° (via fourth interconnecting transmission line segment TLS4). The fifth phase-shifting stage includes two half-stages 92*i*, 92*j*, which are responsive to a fifth pair of actuator drive signals (V1_5, V2_5) and collectively provide a phase delay of 0° or 180° (via fifth interconnecting transmission line segment TLS5).

Thus, based on the illustrated configuration of five serially-connected stages, the phase shifter assembly 90 is capable of providing a programmable time/phase delay to an RF input signal in a range from 0° to 360°-N°, in N° increments (e.g., 11.25° increments). Accordingly, a 5-bit actuator drive signal equal to 0b yields a 0° phase delay and a 5-bit actuator drive signal equal to 31 b yields a 348.75° phase delay (i.e., 360°-11.25°), where "b" designates "binary" notation and each bit of the actuator drive signal has a "digital" value of (1,0) or (0,1).

Figure 10A:
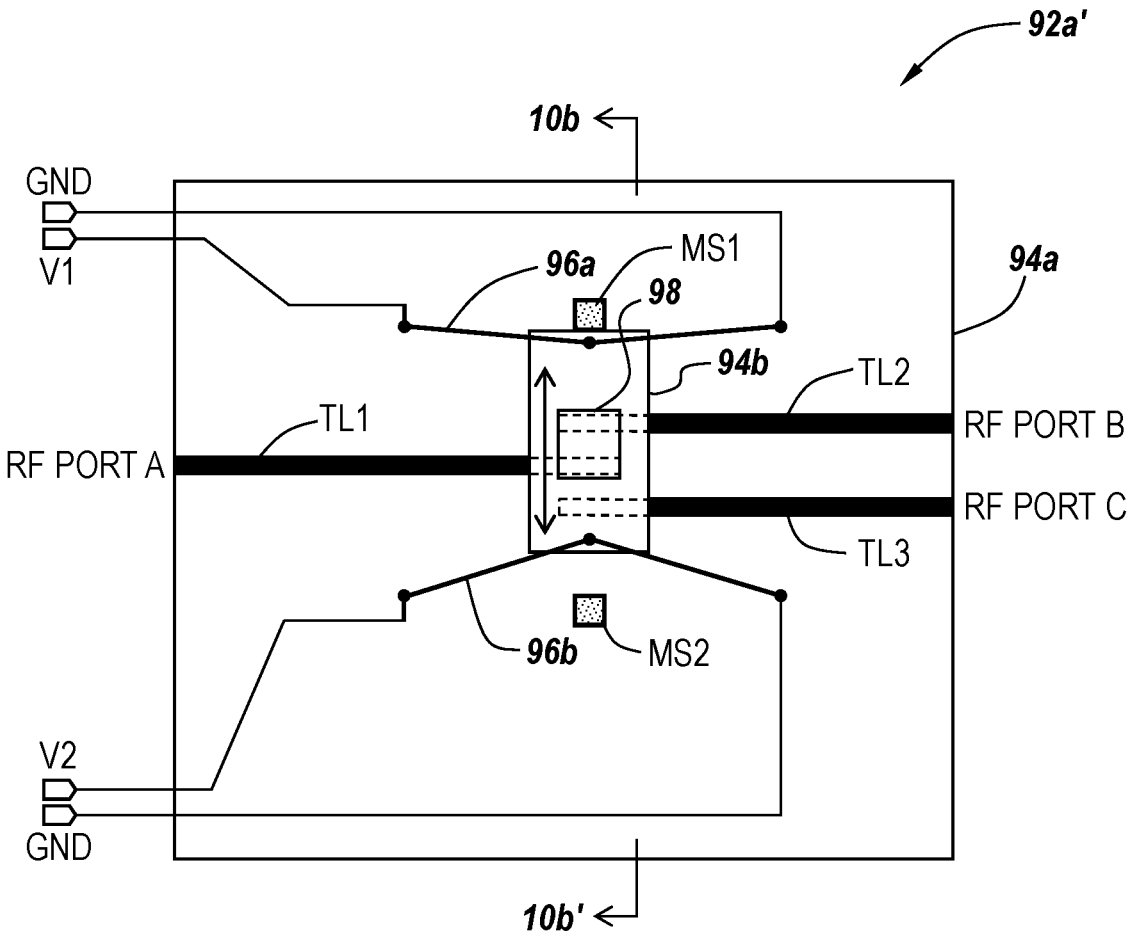
FIG. 10A is a plan view of a shape-memory alloy (SMA) switch, which may be utilized within the phase-shifting stages of FIG. 9, according to an embodiment of the invention.
Figure 10B:
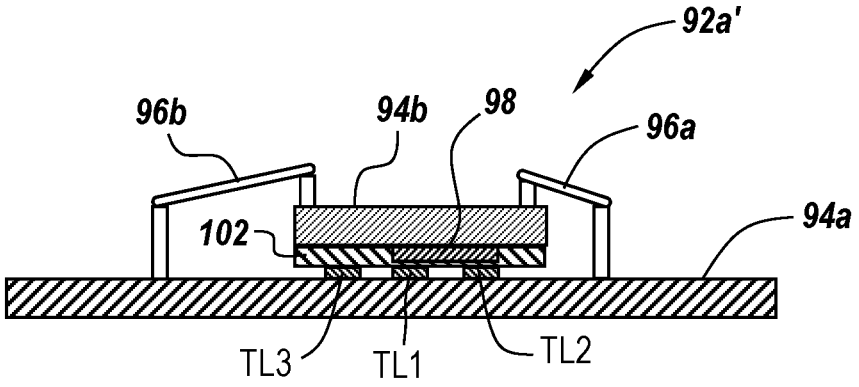
FIG. 10B is a cross-sectional view of the SMA switch of FIG. 10A, taken along lines 10*b*-10*b'*.

Referring now to FIGS. 10A-10B, the half-stage 92*a* of FIG. 9 may be configured as a shape-memory alloy (SMA) switch 92*a*'. This switch 92*a*' is illustrated as including a primary circuit board 94*a* on which a plurality of microstrip transmission lines/segments TL1, TL2 and TL3 are patterned and extend to respective RF ports A, B and C. As shown, a secondary "actuator" circuit board 94*b* is provided, which faces the underlying primary circuit board 94*a* and includes a rectangular shaped conductor 98 thereon, which is covered with a thin dielectric material 102 (e.g., parylene) as shown in FIG. 10B. The rectangular shaped conductor 98 and the dielectric material 102 form a capacitive junction to electrically couple TL1 and TL2 together when the actuator circuit board 94*b* overlaps TL1 and TL2, as shown in FIGS. 10A-10B, or form a capacitive junction to electrically couple TL1 and TL3 together when the actuator circuit board 94*b* overlaps TL1 and TL3.

As shown by FIG. 10A, when a shape-memory alloy (SMA) wire 96*a* is heated in response to a positive drive signal V1 and an SMA wire 96*b* is disabled (i.e., V2=GND), the SMA wire 96*a*, which is anchored to the primary circuit board 94*a* and mechanically attached to the actuator circuit board 94*b*, will contract to thereby pull the actuator circuit board 94*b* (and conductor 98) to overlap and electrically couple together the first and second transmission line segments TL1 and TL2. A mechanical stop MS1 positioned at a location on the primary circuit board 94*a* fixes the final position of the actuator circuit board 94*b* so that the conductive path on the actuator circuit board 94*b* is correctly aligned above TL1 and TL2 in order to most efficiently couple the RF signal to port B. In contrast, when the SMA wire 96*b* is heated in response to a positive drive signal V2 and the SMA wire 96*a* is disabled (i.e., V1=GND), the SMA wire 96*b*, which is also anchored to the primary circuit board 94*a* and mechanically attached to the actuator circuit boar 94*b*, will contract to thereby pull the actuator circuit board 94*b* (and conductor 98) to overlap and electrically couple together the first and third transmission line segments TL1 and TL3. A mechanical stop MS2 positioned at a location on the primary circuit board 94*a* fixes the final position of the actuator circuit board 94*b* so that the conductive path on the actuator circuit board 94*b* is correctly aligned above TL1 and TL3 in order to most efficiently couple the RF signal to port C.

Figure 10C:
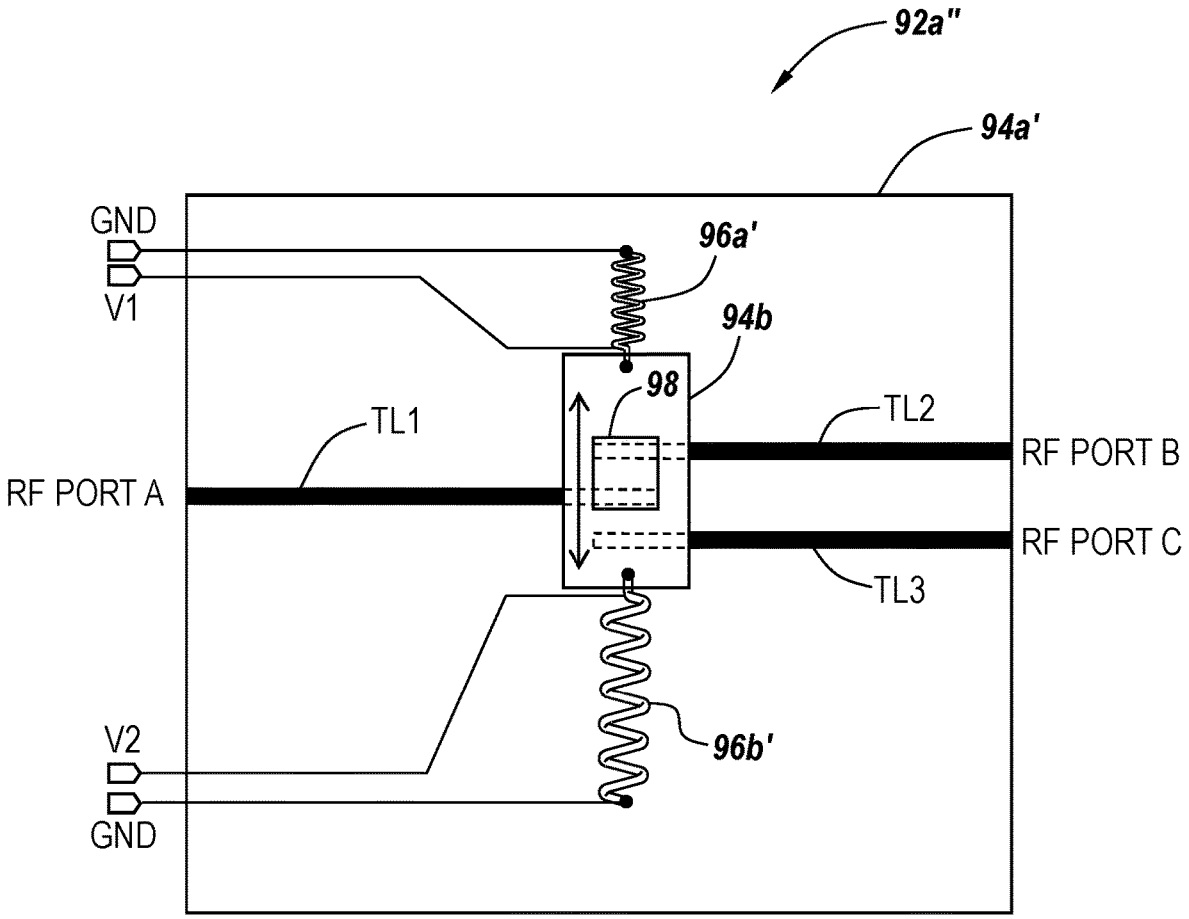
FIG. 10C is a plan view of a shape-memory alloy (SMA) switch with SMA springs, which may be utilized within the phase-shifting stages of FIG. 9, according to an embodiment of the invention.

Alternatively, as shown by the SMA switch 92*a*" of FIG. 10C, when SMA spring 96*a*' is heated in response to a positive drive signal V1 and an SMA spring 96*b*' is disabled (i.e., V2=GND), the SMA spring 96*a*' will contract to thereby pull the actuator circuit board 94*b* and conductor 98 to overlap and electrically couple together the first and second transmission line segments TL1 and TL2 located on the primary circuit board 94*a*'. Alternatively, when the SMA spring 96*b*' is heated in response to a positive drive signal V2 and the SMA spring 96*a*' is disabled (i.e., V1=GND), the SMA spring 96*b*' will contract to thereby pull the actuator circuit board 94*b* and conductor 98 to overlap and electrically couple together the first and third transmission line segments TL1 and TL3 located on the primary circuit board 94*a*'. In this manner, the SMA wires 96*a*, 96*b* of FIG. 10A and the SMA springs 96*a*', 96*b*' of FIG. 10C operate in an opposing pull-pull configuration when independently actuated during non-overlapping time intervals. Moreover, by appropriate dimensioning of the transmission line segments and conductor 98 of each phase-shifting stage, an RF switch capable of handling high RF power in excess of 100 W can be achieved.

In the drawings and specification, there have been disclosed typical preferred embodiments of the invention and, although specific terms are employed, they are used in a generic and descriptive sense only and not for purposes of limitation, the scope of the invention being set forth in the following claims. In addition, the recitation "phase shifter(s)" in the claims is to be properly interpreted as covering devices that provide relative constant phase shifts as a function of frequency and those providing somewhat varying phase shifts (e.g., linearly varying) as a function of frequency, which is typical of many time delay units.

That which is claimed is:

1. A base station antenna, comprising:

at least one phase shifter having a variable length signal path therein, which provides an adjustable signal delay in response to mechanical actuation thereof; and a thermo-electric actuator configured to mechanically actuate the signal path in response to an actuator drive signal, said thermo-electric actuator comprising:

a first pair of thermally-deformable components that are configured in an opposing pull-pull configuration and independently actuated during non-overlapping first and second time intervals to thereby switch the variable length signal path between first and second signal path segments; and a second pair of thermally-deformable components that are configured in an opposing pull-pull configuration and independently actuated during the non-overlapping first and second time intervals to thereby switch the variable length signal path between third and fourth signal path segments; and wherein the first and third signal path segments are electrically coupled end-to-end by a first transmission line segment and the second and fourth signal path segments are electrically coupled end-to-end by a second transmission line segment having different signal delay characteristics relative to the first transmission line segment.

2. The base station antenna of claim 1, wherein each of the thermally-deformable components has a first shape when heated by the actuator drive signal to a temperature above a threshold temperature and a second different shape when cooled to a temperature below the threshold temperature.

3. The base station antenna of claim 2, wherein the first shape is present when the thermally-deformable component is in a contracted state and the second shape is present when the thermally-deformable component is in an uncontracted state, or vice versa.

4. The base station antenna of claim 2, wherein the thermally-deformable component comprises a shape-memory alloy (SMA).

5. The base station antenna of claim 4, wherein the thermally-deformable component is configured as an SMA spring.

6. The base station antenna of claim 2, wherein the thermally-deformable component comprises a shape-memory alloy (SMA) selected from a group consisting of Fe—Mn—Si, Cu—Zn—Al, Cu—Al—Ni and Ni—Ti.

7. The base station antenna of claim 1, wherein a first of said at least one phase shifter comprises a plurality of phase-shifter stages electrically coupled in series; and wherein the plurality of phase-shifter stages are binary-weighted.

8. The based station antenna of claim 7, wherein the plurality of phase-shifter stages are binary-weighted to thereby provide 0° to (360-N°) phase shifts to a radio frequency (RF) signal, in N° increments, where N is a positive real number.

9. The base station antenna of claim 8, wherein the actuator drive signal comprises a binary-weighted multi-bit drive signal.

* * * * *